US007280891B2

(12) United States Patent
Chase et al.

(10) Patent No.: US 7,280,891 B2
(45) Date of Patent: Oct. 9, 2007

(54) SIGNAL PROCESSING TECHNIQUE FOR IMPROVED FLAME SCANNER DISCRIMINATION

(75) Inventors: Paul H. Chase, East Granby, CT (US); James M. Niziolek, Enfield, CT (US); Terry M. Grayson, Granby, CT (US); Gregory F. Rossano, Enfield, CT (US)

(73) Assignee: ABB Inc., Norwalk, CT (US)

( * ) Notice: Subject to any disclaimer, the term of this patent is extended or adjusted under 35 U.S.C. 154(b) by 0 days.

(21) Appl. No.: 11/003,565

(22) Filed: Dec. 3, 2004

(65) Prior Publication Data

US 2005/0130087 A1 Jun. 16, 2005

Related U.S. Application Data

(60) Provisional application No. 60/528,736, filed on Dec. 11, 2003.

(51) Int. Cl.
*G01M 1/38* (2006.01)

(52) U.S. Cl. ..... 700/275; 431/76

(58) Field of Classification Search ..... 700/209, 700/282, 275, 274, 211, 210, 272, 50, 266; 299/300; 110/185, 190; 250/372, 554, 578; 126/19.5, 345; 219/200–553; 431/79, 75, 431/12, 76, 14; 340/578, 577, 579; 356/326; 53/478, 141

See application file for complete search history.

(56) References Cited

U.S. PATENT DOCUMENTS 4,317,045 A * 2/1982 Coe et al. ..... 250/554
5,077,550 A * 12/1991 Cormier ..... 340/578
5,755,819 A 5/1998 Bonanni et al.
6,024,561 A * 2/2000 Kemp et al. ..... 431/79
6,192,660 B1 * 2/2001 Moriyama et al. ..... 53/478
6,268,913 B1 * 7/2001 Rising ..... 356/326
6,356,199 B1 * 3/2002 Niziolek et al. ..... 340/579
6,389,330 B1 5/2002 Khesin
6,472,669 B1 * 10/2002 Chase et al. ..... 250/372
6,676,404 B2 * 1/2004 Lochschmied ..... 431/75

FOREIGN PATENT DOCUMENTS

EP 0 474 430 A1 3/1992
EP 1 010 943 A2 6/2006
GB 2 261 944 A 6/1993
WO PCT/US2004/040448 3/2004

* cited by examiner

*Primary Examiner*—Kidest Bahta
(74) *Attorney, Agent, or Firm*—Michael M. Rickin; Paul R. Katterle

(57) ABSTRACT

A signal processing technique that allows the flame signal from a first source of flame and the flame signal from a second source of flame to be discriminated from each other when only both the first and second flame signals are viewed by the same flame scanner. The signal from the flame scanner is processed to enhance one or more of the attributes associated with the first flame and is simultaneously processed to enhance one or more attributes associated with the second flame.

13 Claims, 1 Drawing Sheet

SIGNAL PROCESSING TECHNIQUE FOR IMPROVED FLAME SCANNER DISCRIMINATION

CROSS REFERENCE TO RELATED APPLICATION

This application claims the priority of U.S. provisional patent application Ser. No. 60/528,736 filed on Dec. 11, 2003, entitled "Signal Processing Technique For Improved Flame Scanner Discrimination" the contents of which are relied upon and incorporated herein by reference in their entirety, and the benefit of priority under 35 U.S.C. 119(e) is hereby claimed.

FIELD OF THE INVENTION

This invention relates to industrial flame scanner instrumentation and more particularly to such instrumentation that is required to distinguish, that is, discriminate, flames from different fuels being alternately burned in the same burner or discriminate the flame between burner and adjacent ignitor where the ignitor may be burning the same or different fuel than the main burner.

DESCRIPTION OF THE PRIOR ART

Flame scanners are important instruments in the operation of the combustion systems of fossil fuel-fired steam generators. To this end, flame scanners are one of the primary inputs into the burner management system normally provided with the steam generator. The principal function of a flame scanner is to monitor the combustion process in the steam generator and to provide when a stable flame exists a signal which gives an indication that it is safe to continue feeding fossil fuel into the combustion chamber of the steam generator.

In the event that the flame becomes unstable, or the flame is lost completely, the flame scanner is designed to provide a loss of flame signal to the burner management system. In response to the loss of flame signal, the burner management system shuts off the fossil fuel to the steam generator before an unsafe operating condition develops within the steam generator.

One requirement in determining if a stable flame exists or if the flame has become unstable or lost is that the flame scanner must be able to discriminate flames between adjacent burners or between burner or ignitor or between different fuels in a burner. One example of a flame scanner that can discriminate flames between adjacent burners is the silicon carbide photodiode based flame scanner described in commonly owner U.S. Pat. No. 6,472,669 ("the '669 patent") which issued on Oct. 29, 2002. The disclosure of the '669 patent is incorporated herein by reference.

Common practice in discriminating flames between different burners or between burner and ignitor or between different fuels in a burner, is to design a system that can detect and act upon a flame signal signature that is specific to the fuel type or burner/ignitor mechanical configuration. There are a number of factors that contribute to flame signal signatures. Examples are fuel type, fuel to air ratios, scanner location in relation to flame ignition points, flame profile in relation to the scanner position, flame scanner sighting angle, burner load, and boiler load. All of these factors, and others, combine to create a unique flame signature.

The art of flame discrimination techniques is in the ability to recognize the differences between the signatures emanating from two flame sources. Most often these differences are minute and lead to marginal discrimination performance. Sometimes the differences between flame sources have overlapping characteristics as the burner or boiler progresses through its operating load range making discrimination impossible during a segment of time.

Typically, the raw flame scanner signal, as it comes from the scanner head, is conditioned and then processed to detect particular attributes associated with either the fuel or burner for which the scanner is assigned to discriminate. Once an attribute is detected, it is then compared to predetermined trip limits for recognition as flame or no flame. It is desirable to find the associated attributes in a timely and consistent fashion. Examples of typical attributes include intensity, flicker frequency, and AC amplitude.

In accordance with the present invention the flame signal is conditioned in parallel paths allowing the signal attributes to be enhanced according to the assigned programmed trip settings while at the same time suppressing the attributes of the alternate flame. This conditioning increases the attribute separation, making detection more predictable, timely and consistent.

SUMMARY OF THE INVENTION

A method to discriminate flame between a first flame having a predetermined number of associated flame attributes and a second flame having a predetermined number of associated flame attributes. The first and second flames are viewed by a single flame scanner and the flame scanner produces a signal indicative of the first and second flames. The method:

simultaneously processes the flame indicative signal to enhance one or more of the predetermined number of first flame associated flame attributes and to enhance the one or more of the predetermined number of second flame associated flame attributes;

determines when the enhanced one or more of the predetermined number of first flame associated flame attributes exceeds an associated predetermined threshold;

and determines when the enhanced one or more of the predetermined number of second flame associated flame attributes exceeds an associated predetermined threshold.

A fossil fuel fired steam generator that has:

a source for producing a first flame, the first flame having a predetermined number of associated flame attributes;

a source for producing a second flame, the second flame having a predetermined number of associated flame attributes;

a flame scanner for viewing both the source of the first flame and the source of the second flame and producing a signal indicative of the first flame and of the second flame;

means for simultaneously processing the flame scanner signal to enhance one or more of the predetermined number of flame attributes associated with the first flame and to enhance the one or more of the predetermined number of flame attributes associated with the second flame; and means for determining when the enhanced one or more of the predetermined number of flame attributes associated with the first flame exceeds an associated predetermined threshold and when the enhanced one or more of the predetermined number of flame attributes associated with the second flame exceeds an associated predetermined threshold.

DETAILED DESCRIPTION

Figure 1:
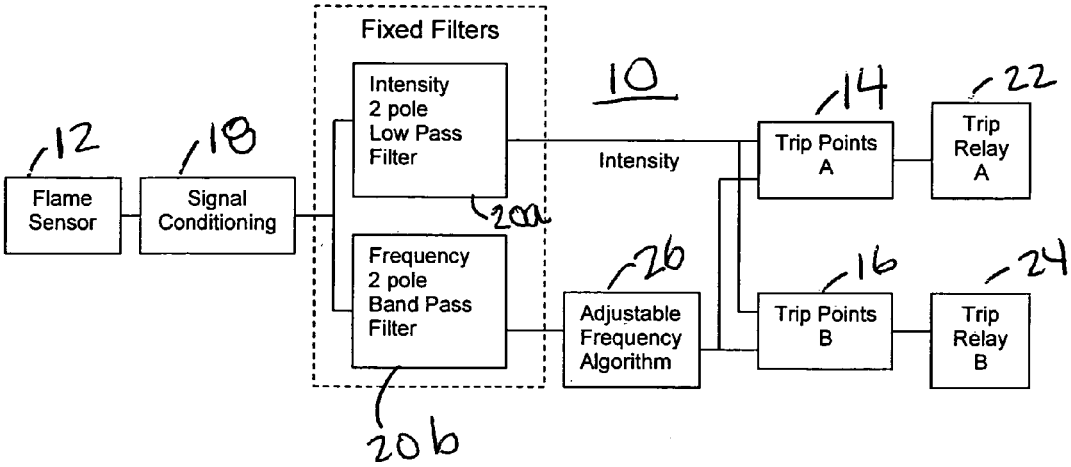
Fig. 1 (Prior Art)
FIG. 1 shows a block diagram of a prior art approach to discriminate flames from fuels being alternately burned in the same burner or discriminate the flame between burner and adjacent ignitor where the burner may be burning the same or different fuel than the main burner.

Referring now to FIG. 1 there is shown the block diagram of a circuit 10 of the traditional, that is, prior art, approach, when the flame scanner instrumentation is required to distinguish, that is, discriminate, between flames from two sources. The two flame sources may be different fuels being alternately burned in the same burner or the flame between burner and adjacent ignitor where the ignitor may be burning the same or different fuel than the main burner.

As is shown in FIG. 1, in circuit 10 the same conditioned and filtered signal from the flame scanner 12 is passed to circuitry which has the programmable trip points for flame "A" 14 and flame "B" 16. For example, flame "A" represents a burner flame, and flame "B" represents an adjacent ignitor flame. Flame "A" is known to generate a flame signal with slightly less flicker frequency then flame "B" during some operating conditions but not all operating conditions. This makes discrimination between the two flames impossible over the entire range of operating conditions since the same conditioned and filtered flame signal is used by the trip points for flame "A" and flame "B".

In the circuit of FIG. 1, the signal from scanner 12 is conditioned at 18 and then filtered by fixed filters 20*a* and 20*b*. Fixed filter 20*a* filters the conditioned signal from scanner 12 for intensity using a two pole low pass filter. That intensity filtered and conditioned signal is fed to both trip points for flame A 14 and trip points for flame B 16. Fixed filter 20*b* filters the conditioned signal from scanner 12 for frequency using a two pole low pass filter. That frequency filtered and conditioned signal is fed through adjustable frequency algorithm 26 to both trip points for flame A 14 and trip points for flame B 16. Trip points for flame A 14 is connected to trip relay A 22 and trip points for flame B 16 is connected to trip relay B 24.

Figure 2:
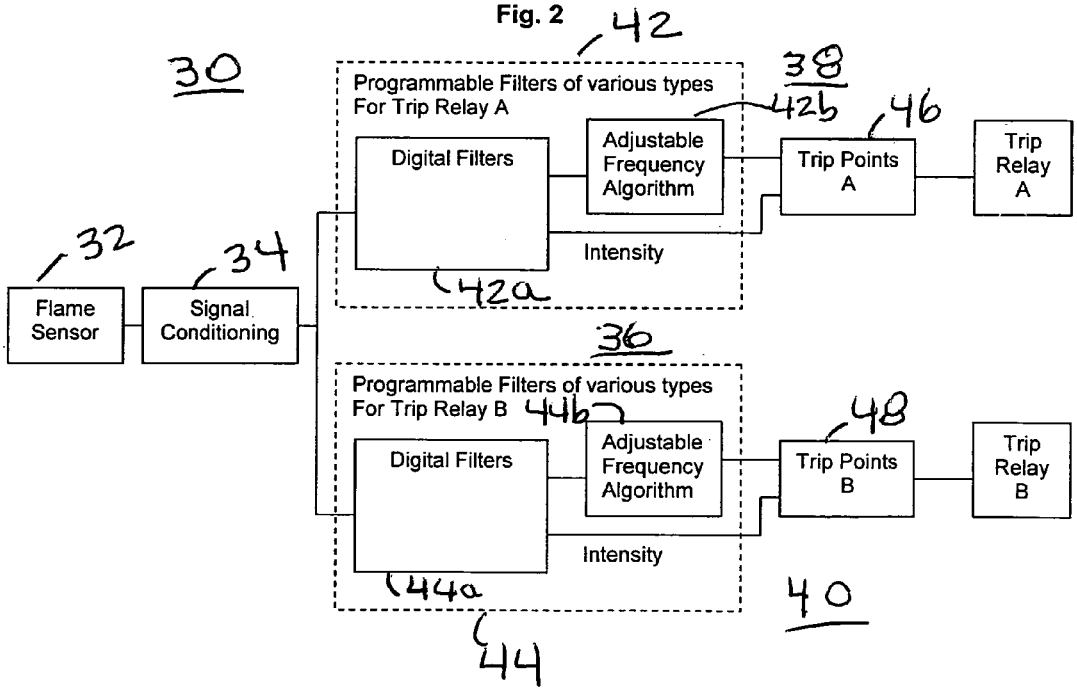
FIG. 2 shows a block diagram of the approach of the present invention to such flame discrimination.

Referring now to FIG. 2, there is shown the block diagram for a circuit 30 where the raw flame signal from flame sensor 32 is first conditioned by signal conditioner 34 and then enters a parallel network 36 having branches 38 and 40. Branch 38 has a programmable filter 42 which processes the conditioned signal in a manner to enhance flame "A" flicker frequencies and branch 40 has a programmable filter 44 which processes the conditioned signal in a manner to enhance flame "B" flicker frequencies. Each parallel programmable filter 42, 44 may be programmed to "feature" the raw conditioned flame signal in such a way as to widen the separation between flicker frequency "A" and flicker frequency "B", thus generating a discrimination signal that is now distinguishable over the entire range of operating conditions.

Programmable filter 42 comprises digital filters 42*a* which filters the conditioned flame signal for intensity and adjustable frequency algorithm 42*b* connected to the output of: digital filters 42*a*. The output of adjustable frequency algorithm 42*b* is connected to trip points A 46 as is one output of digital filters 42*a*. Programmable filter 44 also comprises digital filters 44*a* which filters the conditioned flame signal for intensity and adjustable frequency algorithm 44*b* connected to the output of digital filters 44*a*. The output of adjustable frequency algorithm 44*b* is connected to trip points B 48 as is one output of digital filters 44*a*.

For a more specific example, consider the case where the scanner must discriminate between an oil flame and a coal flame. The oil flame normally has a characteristically higher flicker frequency then the coal flame. For this example the coal flicker frequency is higher than normal and is approaching the oil flicker frequency making separation of the fuels difficult and only marginally reliable over the entire operation load range using the techniques shown in the conventional circuit 10 of FIG. 1 as the adjustable frequency algorithm 26 is adjusted to either enhance the high frequency harmonics that are routinely found in the oil flame while suppressing the low frequency harmonics routinely found in the coal flame or enhance the low frequency coal harmonics while suppressing the high frequency oil harmonics.

However, in the technique shown in the circuit 30 of the present invention, the digitally filtered and conditioned flame signal passes through an adjustable frequency algorithm for example algorithm 42*b*, that is adjusted to enhance the high frequencies that are routinely found in the oil flame, while suppressing the low frequency harmonics routinely found in the coal flame.

In the same fashion, the adjustable frequency algorithm, for example 44*b*, on the coal side of the parallel branches 38 and 40, enhances the low frequency coal harmonics while suppressing the high frequency oil harmonics. Thus the two resulting coal and oil flame signals have the resulting frequencies that are further separated making discrimination between the two more predicable over the entire burner load range.

In addition to flicker frequency, the present invention can have different trip points for other flame attributes, such as intensity and/or flame signal amplitude. The flame signals may also be conditioned or shaped, that is, pre-processed, using the parallel programmable filters 42 and 44 to enhance individual flame attributes. Examples of such filtering techniques include but are not limited to Fourier analysis, box car averaging, scaling, band pass, low pass or other filter techniques. The conditioning algorithms are configurable such that two separate configurations are executed simultaneously on the same sensor data. Each configuration is used to enhance the differences between the two flames and make it easier to detect the presence of each one.

In both the traditional approach and the present invention that flame scanner 10 may be embodied for example as described in the '669 patent or may use ionic flame monitoring as is described in commonly owned U.S. Pat. No. 6,356,199 ("the '199 patent") which issued on Mar. 12, 2002. The disclosure of the '199 patent is incorporated herein by reference.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A method to discriminate flame between a first flame having an associated first flame attribute and a second flame having an associated second flame attribute, wherein said first and second flames are different and said first and second flame attributes are different, said first and second flames being viewed by a single flame scanner and said flame scanner producing a flame signal indicative of said first and second flames, the method comprising:

simultaneously processing said flame signal to enhance said first flame attribute and to enhance said second flame attribute;

determining when said enhanced first flame attribute exceeds an associated predetermined threshold; and determining when said enhanced second flame attribute exceeds an associated predetermined threshold.

2. The method of claim 1 further comprising operating a trip relay associated with said first flame when said enhanced first flame attribute is determined to exceed said associated predetermined threshold.

3. The method of claim 1 further comprising operating a trip relay associated with said second flame when said enhanced second flame attribute is determined to exceed said associated predetermined threshold.

4. The fossil fuel fired steam generator of claim 3 further comprising a trip relay associated with said source of said first flame and a trip relay associated with said source of said second flame.

5. The method of claim 1, wherein said first flame attribute comprises a high flame flicker frequency, and wherein said second flame attribute comprises a low flame flicker frequency.

6. The method of claim 5, wherein said first flame is an oil flame and said second flame is a coal flame.

7. The method of claim 1, wherein the step of simultaneously processing said flame signal comprises processing said flame signal in a first programmable filter and processing said flame signal in a second programmable filter, and wherein each of said first and second programmable filters comprises an adjustable frequency algorithm and a digital filter that filters said flame signal for intensity.

8. The method of claim 7, wherein said processing of said flame signal in said first programmable filter comprises enhancing a high flame flicker frequency and suppressing a low flame flicker frequency, and wherein said processing of said flame signal in said second programmable filter comprises enhancing said low flame flicker frequency and suppressing said high flame flicker frequency.

9. A fossil fuel fired steam generator comprising:

a source for producing a first flame, said first flame having a first flame attribute;

a source for producing a second flame, said second flame having a second flame attribute, said second flame being different from said first flame and said second flame attribute being different from said first flame attribute;

a flame scanner for viewing both said source of said first flame and said source of said second flame and producing a flame signal indicative of said first flame and of said second flame;

means for simultaneously processing said flame signal to enhance said first flame attribute and to enhance said second flame attribute; and means for determining when said enhanced first flame attribute exceeds an associated predetermined threshold and when said enhanced second flame attribute exceeds an associated predetermined threshold.

10. The fossil fuel fired steam generator of claim 9, wherein said first flame attribute comprises a high flame flicker frequency, and wherein said second flame attribute comprises a low flame flicker frequency.

11. The fossil fuel fired steam generator of claim 10, wherein said first flame is an oil flame and said second flame is a coal flame.

12. The fossil fuel fired steam generator of claim 9, wherein said means for simultaneously processing said flame indicative signal comprises first and second programmable filters, and wherein each of said first and second programmable filters comprises an adjustable frequency algorithm and a digital filter that filters said flame indicative signal for intensity.

13. The fossil fuel fired steam generator of claim 12, wherein said first programmable filter enhances a high flame flicker frequency and suppresses a low flame flicker frequency, and wherein said second programmable filter enhances said low flame flicker frequency and suppresses said high flame flicker frequency.

* * * * *